United States Patent [19]

Clauser

[11] 4,052,973

[45] Oct. 11, 1977

[54] INTERNAL COMBUSTION ENGINE AND A PROCESS FOR ITS OPERATION

[75] Inventor: Francis H. Clauser, Pasadena, Calif.

[73] Assignee: California Institute of Technology, Pasadena, Calif.

[21] Appl. No.: 374,799

[22] Filed: June 28, 1973

[51] Int. Cl.[2] ..... F02B 19/10; F02B 19/16

[52] U.S. Cl. ..... 123/32 ST; 123/139 AW

[58] Field of Search ..... 123/32 CY, 32 ST, 32 SP, 123/139 AW, 75 BC, 119 R

[56] References Cited

U.S. PATENT DOCUMENTS

| | | | |
|---|---|---|---|
| 838,399 | 12/1906 | Greuter | 123/75 B |
| 1,481,955 | 1/1924 | Burtnett | 123/75 B |
| 2,884,913 | 5/1959 | Heintz | 123/32 ST |
| 2,888,912 | 6/1959 | Brueder | 123/139 AW |
| 2,986,129 | 5/1961 | Henry-Biabaud | 123/139 AW |
| 3,113,561 | 12/1963 | Heintz | 123/32 ST |
| 3,170,445 | 2/1965 | Folcke | 123/32 ST |
| 3,680,305 | 8/1972 | Miller | 123/32 ST |

*Primary Examiner*—Ronald B. Cox

*Attorney, Agent, or Firm*—Christie, Parker & Hale

[57] ABSTRACT

In a standard internal combustion engine, air induction through an inlet valve into each combustion chamber occurs only approximately 25 to 50 percent of the time. During the intervals between inductions, air in a channel upstream from the closed intake valve is quiet and stands virtually still. Fuel is injected into the channel upstream from the inlet valve during the quiet time between valve openings to form a combustible cloud in the channel. When the inlet valve opens, the cloud and accompanying air travel serially from the channel into a unitary combustion chamber of the engine. Injection is at a place in the channel such that the cloud will surround the spark plug at spark. At spark, the remainder of the combustion chamber contains air, or a very lean mixture of fuel and air. The same quiet period may be used to form clouds of desired fluid diluents in the channel, such as exhaust gases and water, for transport into the combustion chamber into desired zones. Power may be controlled by adjusting the flow of fuel, by adjusting the spark timing, and by adjusting the amount of diluent addition.

15 Claims, 6 Drawing Figures

INTERNAL COMBUSTION ENGINE AND A PROCESS FOR ITS OPERATION

BACKGROUND OF THE INVENTION

The present invention relates in general to heterogeneous charged, internal combustion engines, and, more in particular, to such an engine and process for its operation wherein one or more desired fluids have a tailored distribution in a combustion chamber achieved by forming clouds of the fluids at selected locations in an inlet channel during the quiet period between openings of the channel into the combustion chamber and inducting the clouds and air into the chamber by standard induction processes.

The problem of exhaust gas emission from internal combustion engines has become so serious that drastic legislation requires the reduction in the emissions of the oxides of nitrogen, unburned hydrocarbons, and carbon monoxide to extremely low levels relative to those produced by an engine without emission controls.

To achieve low emissions, internal combustion engines have been modified and are proposed to be modified in a number of ways. Modifications for emissions control include: making the fuel-to-air ratio leaner in fuel, exhaust gas recirculation into the combustion chamber, retardation of spark, and catalysis of exhaust gases to form harmless products. The controls have resulted in performance compromises in fuel economy, power and responsiveness.

Past experience has shown that it is difficult to make internal combustion engines run well when the mixture ratio of fuel and air is less than the stoichiometric ratio, that is, fuel-lean. In fact, the great majority of pre-emission controlled engines operated with mixture ratios rich in fuel. Because of the absence of sufficient air to burn the fuel completely, the exhaust of such engines contained relatively large amounts of unburned fuel and of carbon monoxide. If it were possible to operate internal combustion engines successfully at mixture ratios lean in fuel, the resulting exhaust would contain very little unburned fuel and very little carbon monoxide.

Oxides of nitrogen are produced in large quantities when combustion temperatures are high. Upon expansion and exhaust, the resultant cooling quenches the reactions and freezes the formed oxides, preventing a reversal of the reactions which formed the oxides. A reason for the relatively large quantity of nitric oxide emissions, it is thought, is that the first quantity of a homogeneous combustible mixture burned is compressed and elevated in temperature by the subsequent burning of the remainder of the charge, thereby enhancing the formation of oxides of nitrogen. Maximum combustion temperatures occur when mixture ratios are near stoichiometric and are at a maximum at slightly fuel-lean operation. When combustion temperatures are reduced, by using either rich or lean mixtures, or by introducing diluents such as water or recirculated exhaust gases, the production of oxides of nitrogen drops relatively rapidly.

Although in the past an important goal of internal combustion engine design has been the achievement of homogeneous mixtures of fuel and air in the combustion chamber at the time of ignition, it is now recognized that a careful tailoring of the distribution of fuel, air and diluents within the combustion chamber at the time of ignition can reduce emissions.

This recognition has led to the so-called stratified or heterogeneous charge engine as an attractive possibility for reducing noxious emissions. In such an engine, the overall temperature of combustion can be made relatively low because, among other things, the compression of the initially burned charge by subsequent combustion is not as great.

Briefly, a heterogeneous charge engine contemplates a tailored distribution of fuel and air. A portion of the charge is fuel-rich with enough air to support combustion. Typically, the remainder of the charge is a zone of either air, or a fuel-lean mixture of fuel and air. The fuel-rich charge is burned and supplies the energy necessary for the burning of any fuel in the lean zone. The effect of the tailored distribution in the engine is to reduce the overall average temperature of combustion. This results in reducing the formation of the oxides of nitrogen. A heterogeneous charge engine also allows combustion at considerably fuel-leaner average overall fuel-to-air ratios than is possible with a homogeneous charge. This lean operation also reduces carbon monoxide and unburned hydrocarbon emissions.

A form of heterogeneous charge engine contemplates the use of only one combustion chamber. Here a charge is stratified by directing two separate streams with different fuel-air ratios into different parts of the combustion chamber. An example of this approach is described in U.S. Pat. No. 3,364,911 to Baudry et al. Another single combustion chamber, stratified charge engine has been developed by the Texas Company and the Ford Motor Company. Their approach creates a swirl of air in the combustion chamber about the axis of the chamber. Fuel is injected into the swirl and a resulting fuel-rich charge is positively ignited by a spark plug.

Another heterogeneous charge engine employs an auxiliary chamber for the initial burning of the fuel-rich mixture. This chamber confines the mixture in the zone of the spark plug to ensure its presence there at the initiation of combustion. Fuel and air are admitted to the pre-chamber by an inlet valve. A separate inlet valve admits a lean mixture of fuel and air or just air into a second and larger chamber in communication with the auxiliary chamber. Combustion in the auxiliary chamber produces a flame front which spreads into the larger, main chamber for completion of combustion with air there and to supply the energy required to sustain combustion of fuel there.

SUMMARY OF THE INVENTION

In internal combustion engines of the reciprocating, rotary, or similar types, the combustible charge is taken into the combustion chamber periodically. Typically this induction flow occurs during one quarter to one half of the total period. During the remainder, the incoming air virtually stands still in the induction channel leading to the intake control means, a valve or port, while the means is closed.

By the present invention, constituents to be added to the air, fuel, water, recirculated exhaust gas, etc., are each injected at a steady or grossly controlled rate at separately selected locations in the intake channel to each combustion chamber, and each will end up in the chamber at the time of ignition at a location which bears a one-to-one correspondence with their injection location in the intake channel. Varying the one location varies the other, giving the designer control of the location and concentration of constituents at the time of ignition. The distribution of desired constituents within the combustion chamber can be readily tailored.

In other words, the position of injection of the cloud is determined experimentally by selecting the position which gives lowest emission and greatest performance, or whatever criterion is sought. Since positions in the intake channel map into a complete coverage of positions in the combustion chamber, any tailored distribution in the latter can be obtained by tailoring in the former.

In a particular application, the present invention provides in a cyclic internal combustion engine a heterogeneous charge obtained for each combustion chamber by injecting a cloud of a combustible mixture into an inlet channel upstream from the inlet valve or port and during the periods of time between inlet valve or port openings. Cloud formation during this time is into air which is quiet, virtually motion-free. The cloud of fuel is formed at a predetermined location along the induction channel so that it is inducted into the combustion chamber and positioned there at the start of the combustion cycle at a tailored location adjacent the spark plug. The balance of the chamber contains air, or air with a small amount of fuel in it, drawn into the chamber serially with the cloud.

An even more particular form of the present invention contemplates the use of a standard four-cycle, spark ignition engine having one or more cylinders. Standard exhaust and inlet valves for each cylinder pass products of combustion from and admit fuel and combustion air into a unitary combustion chamber, respectively. The unitary combustion chamber is one having no physical barrier in it for separating distinct quantities of a fuel and air charge from air, or a mixture of air and fuel, in another part of the combustion chamber. Combustion is initiated by a spark plug in a conventional manner igniting a compressed fuel and air charge when a piston is in the vicinity of top dead center. The induction channel for supplying each cylinder of the engine with fuel and air includes an induction pipe communicating to atmosphere. Means is provided to inject fuel or a mixture of fuel and air into the induction channel at least during the periods of time between inlet valve openings, although it may be preferable to have continuous injection to avoid even the simple valving which would otherwise be required. In the standard four-cycle internal combustion engine, the time between inlet valve openings corresponds to approximately 75 percent of a complete cycle. When the inlet valve opens, the movement of the piston will draw the air and the cloud serially from the induction channel into the combustion chamber. The location of the zone of fuel injection in the intake channel is such that the cloud of fuel formed during the quiescent period in the induction pipe will be carried with the induction air through the pipe, past the inlet valve and into the combustion chamber for arrival of the cloud adjacent to the spark plug at the time of spark.

At the time of spark, the combustion chamber will have a heterogeneous makeup of fuel and air. In the zone adjacent the spark plug the fuel-rich cloud of air and fuel will begin to burn. Outside of this cloud is either a fuel-lean mixture of air and fuel or only air, either of which may be augmented with some desired additional substances, such as recirculated exhaust gas, water, or both. Combustion takes place with the fuel-rich cloud burning and the flame spreading into the fuel-lean zone for the completion of combustion. The result is substantially lower average overall temperatures of combustion with a concomitant reduction in the generation of oxides of nitrogen. This form of combustion permits operation at extremely lean fuel-air ratios.

The quiescent period between inlet valve openings can be used to form clouds of the other desired substances in the induction pipe for induction into the combustion chamber.

The present invention affords a mechanism for varying the power of an engine. Conventional practice with reciprocating, spark ignition, internal combustion engines is to throttle air, keeping the ratio of fuel and air nearly constant. This practice results in pumping losses in an engine when the throttle is only partly open. Since the present invention permits an engine to operate successfully over a wide range of fuel-to-air ratios, it makes possible changing power by changing only the flow of fuel without throttling air. Typically, there can be a reduction of power in this manner from full power to less than half power. Further power reduction may be accomplished by spark retardation and, if desired, by the introduction of recirculated exhaust gases. The result is a broad range of power operation without the necessity of air throttling.

These and other features, aspects and advantages of the present invention will become more apparent from the following description, appended claims and drawings.

DESCRIPTION OF THE PREFERRED EMBODIMENTS

Figure 1:
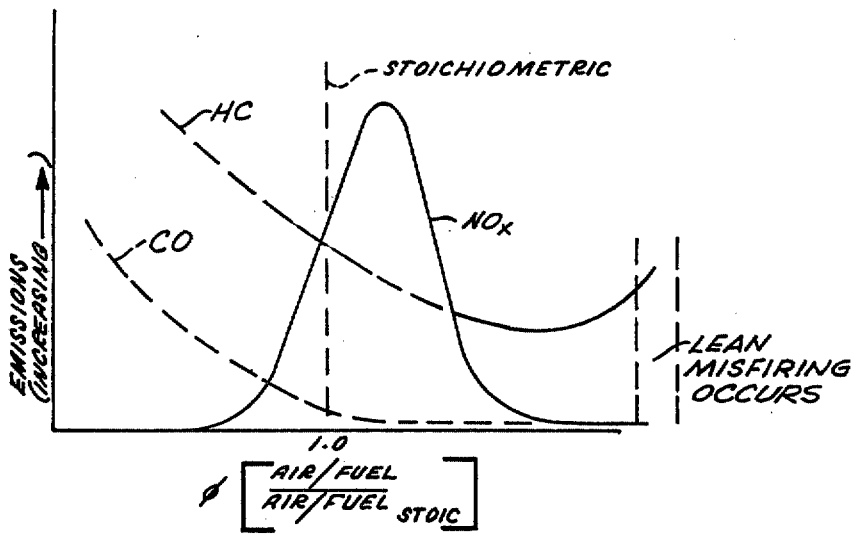
FIG. 1 is a graph showing qualitatively the emissions of carbon monoxide, unburned hydrocarbons and oxides of nitrogen as a function of air-fuel ratio, with the latter being expressed as an equivalence ratio.

With reference to FIG. 1, emissions as a function of air-to-fuel ratio are illustrated for the purpose of understanding one of the attributes of the internal combustion engine of the present invention. The abscissa is air-to-fuel ratio expressed as an equivalence ratio. Equivalence ratio is defined as the actual air-to-fuel ratio divided by the air-to-fuel ratio for stoichiometry. The ordinate qualitatively depicts emissions. With increasing equivalence ratios, a charge becomes leaner in fuel. Carbon monoxide progressively decreases with increasing equivalence ratios because of the availability of more oxygen to combine with carbon during combustion. The same is true of unburned hydrocarbons. Oxides of nitrogen ($NO_x$) are a maximum at slightly leaner than stoichiometric and they decrease rapidly with changes in the equivalence ratio in either direction. The zone at which $NO_x$ is a maximum corresponds approximately to the occurrence of the highest combustion temperatures in an engine. As excess air increases, the temperature within the combustion chamber decreases and so does the amount of $NO_x$. When lean misfiring occurs, unburned hydrocarbons increase rapidly. They also increase before lean misfire because of the inability to support combustion in parts of the chamber. It is clear, then, that operation in the lean range produces conditions which are very helpful in the reduction of noxious emissions.

The present invention permits the engine to be successfully operated in a very lean air-fuel zone. The reason for this is that even when the overall mixture is much too lean to burn, there exists a small cloud of combustible mixture which can burn quite well.

Figure 2:
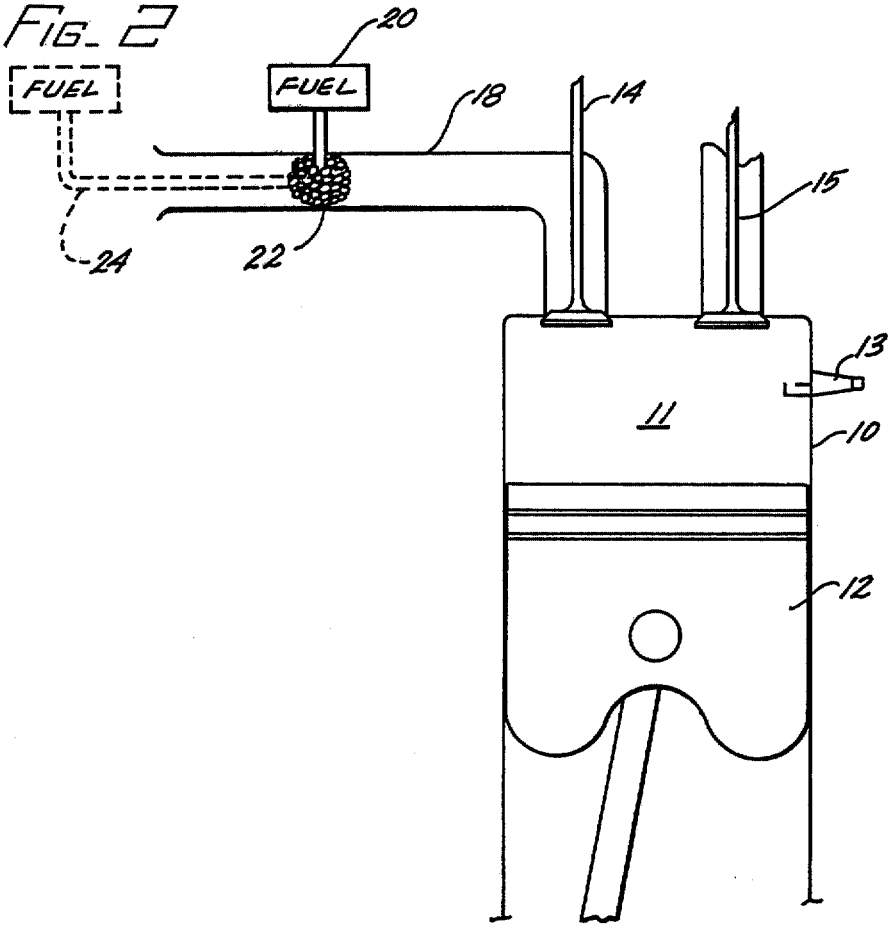
FIG. 2 is a schematic depiction of an internal combustion engine equipped with the induction system of the present invention.
Figure 3:
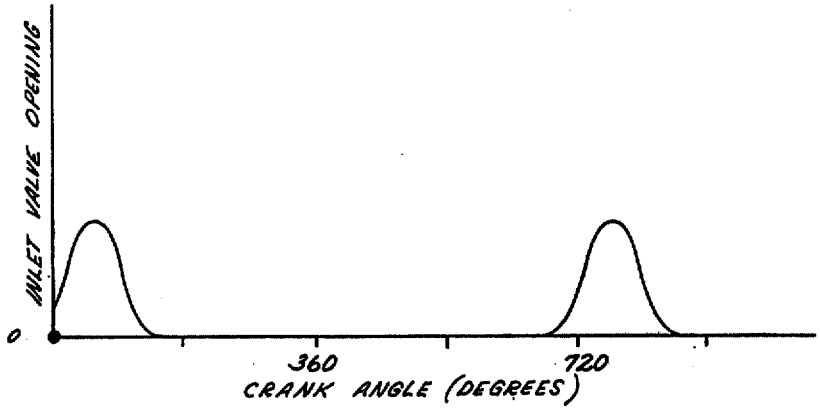
FIG. 3 is a plot of inlet valve opening, qualitatively, versus engine crank angle, in degrees, to illustrate the interval of fuel cloud generation in the induction channel and the interval of induction into the combustion chamber.
Figure 4:
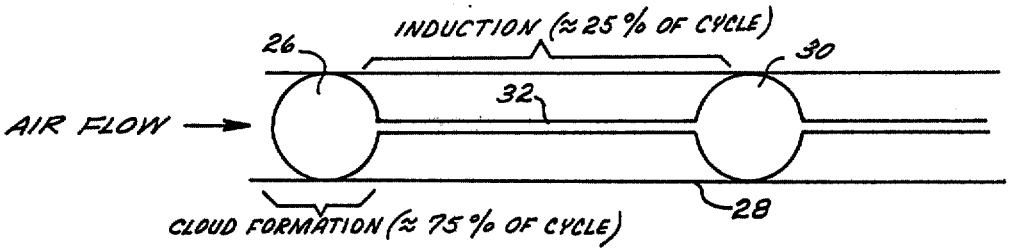
FIG. 4 is a schematic depiction illustrating the phenomenon of cloud formation and transportation in the induction channel.

The principles of the present invention are illustrated in the engine of FIG. 2, and the charts of FIGS. 3 and 4.

For the purpose of illustration, the engine of FIG. 2 is a single cylinder, four-cycle type, such as the standard ASTM-CFR engine of the American Society of Mechanical Engineers Committee on Fuel Research. It has a cylinder 10, defining a combustion chamber 11, a reciprocating piston 12, a spark plug 13, an intake valve 14 and an exhaust valve 15.

The induction channel of the present invention is employed to provide fuel and air for combustion in the engine. The induction channel comprises a conduit or pipe 18 open to the atmosphere at one end, and having an injection means 20 for injecting gaseous fuel or a fine spray of liquid fuel to the interior of the pipe 18 at a predetermined location along the pipe.

The plot of inlet valve opening versus crank angle of FIG. 3 shows that the inlet valve is open for approximately 25 percent of the operating cycle of a cylinder. This means that the induction channel upstream from the inlet valve is relatively quiescent for about 75 percent of the time. Fuel injected into the induction channel by means 20 causes a combustible cloud 22 of fuel and air to form in pipe 18 during the quiescent periods of time while the intake valve 14 is closed.

When the intake valve opens, downward movement of the piston draws air and combustible cloud 22 through the induction system into the combustion chamber. The cloud will remain coherent, or effectively so, during its travels so long as eddying is minimized. This is found to present no problem in a standard CFR engine equipped with a cylindrical induction pipe, and having a right angle bend in the induction track and a standard inlet valve.

The location along the induction track at which the cloud of fuel is formed is selected so as to cause the cloud to be positioned in the cylinder at the spark plug when the latter is energized to begin the combustion process. With the cloud fuel-rich and so positioned, it is surrunded with air or with air having a small amount of fuel in it. This provides fuel-lean combustion at a low overall temperature, thereby reducing the production of undesired oxides of nitrogen.

The location at which the fuel should be injected into the induction track can first be determined quite simply by admitting the fuel through an injector that can be moved along the track, such as through a movable pipe 24 (shown in dashed lines in FIG. 2) extending axially into the induction track 18. The performance of the engine can be measured for various locations until the preferred location is ascertained.

With reference to FIG. 4, cloud formation and transport are illustrated schematically. A cloud 26 formed by injection means in an induction pipe 28 will build up during the quiescent period between inlet valve openings. When the inlet valve opens, air passing through the induction pipe will transport the cloud to the right in FIG. 4, say, to the position illustrated at 30. If injection continues during this transport, a small stream of fuel 32 will appear in the pipe at the radial point of injection. This stream will contribute a small amount of fuel for the fuel-lean zone in the combustion chamber.

The reason that the cloud maintains effective integrity is that eddying is minimized by elimination of intake air throttling. If intake air throttling is desired, the throttle can be placed near the intake entrance and screens or honeycombs used to eliminate the throttling turbulence before the air enters the channel in which injection of fuel or other constituents take place.

It has been found that a cloud of gaseous fluid in the induction channel can be positioned at any desired location in the combustion chamber by injecting it into the induction track at a proper location spaced from the inlet valve. Thus, plural clouds may be positioned in the combustion chamber where desired to form a tailored distribution.

Figure 5:
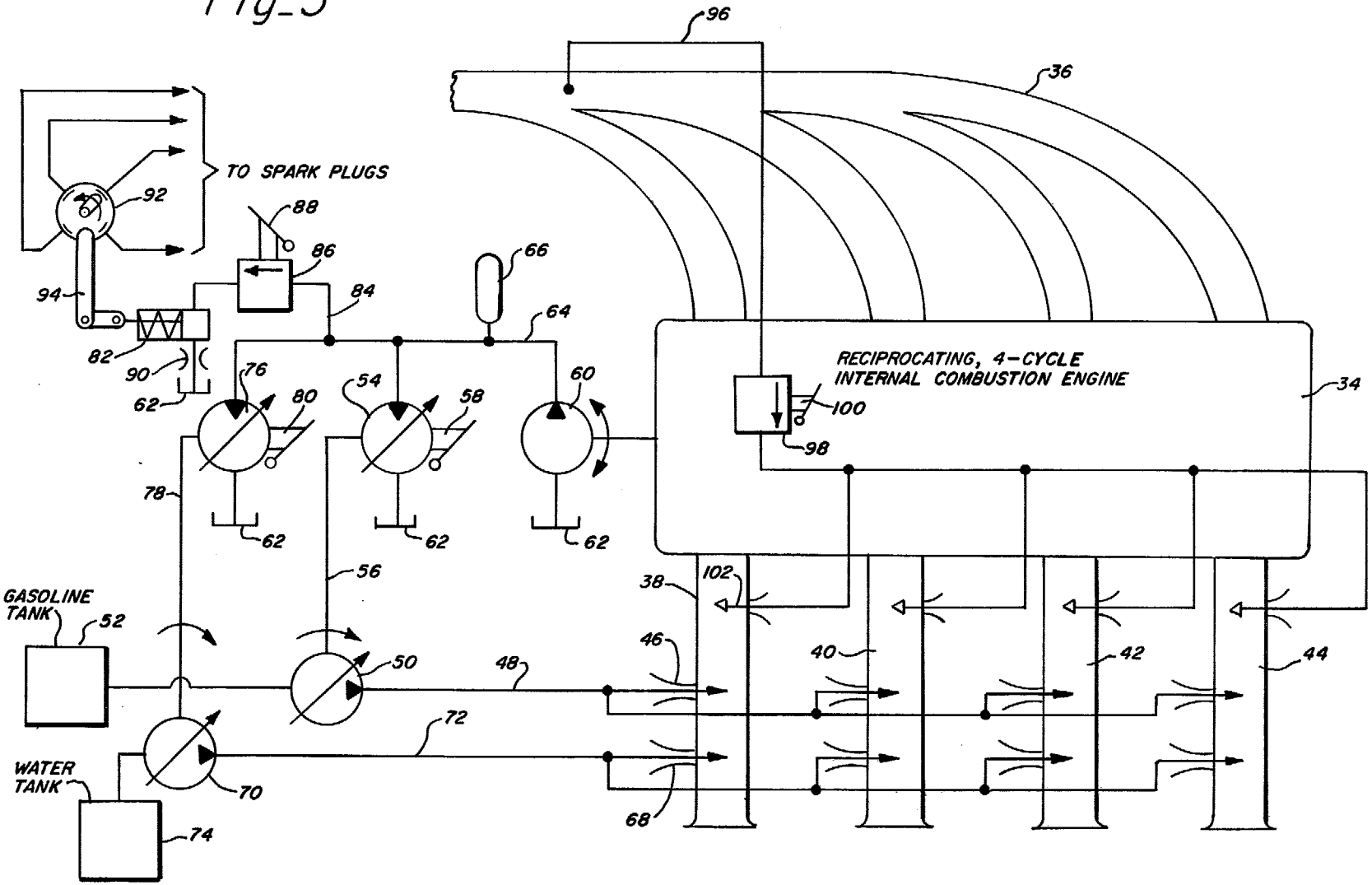
FIG. 5 is a schematic depiction of a multiple cylinder, reciprocating, four-cycle, spark ignition, internal combustion engine having the induction system of the present invention.

With reference to FIG. 5, a multicylinder internal combustion engine in accordance with the present invention is illustrated. The engine is shown in general by reference numeral 34. The engine is a four-cylinder, spark ignition, four-cycle internal combustion engine. Each cylinder exhausts into a manifold 36. An individual induction pipe for each of the cylinders is shown at 38, 40, 42 and 44. Because the induction system for each cylinder is the same, only one will be described in detail.

An injector 46 is capable of injecting atomized fuel into induction pipe 38. The injector should be capable of atomizing gasoline to a particle size small enough to maintain fuel suspension in the induction pipe. The injector forms a fuel-rich cloud of fuel and air during the approximately 75 percent of the time that the interior of pipe 38 is quiet, during the periods of time between inlet valve openings.

The position of the injector along the induction pipe 38 is selected from test data in such a way that the cloud of fuel will envelop the spark plug at the initiation of the spark event. As will be developed subsequently, cloud size is varied from small for low load operation to large for full load operation and the location is such that the smaller cloud will arrive at the spark plug at the required time.

The position of the fuel injector with a variable fuel-to-air ratio engine is determined for the most critical condition. This condition is at the lean limit determined for the engine. At this limit the fuel cloud formed by the injector will have the smallest volume. The distance between the cloud formed during the quiescent portion of the cylinder cycle and the spark plug is determined for the arrival of the small cloud at the spark plug at spark. With increases in richness, the cloud becomes larger and the space it occupies in the combustion chamber is also larger. Accordingly, changes in the time in the cycle at which spark is initiated above the lean limit can occur without affecting ignition simply because larger clouds will be at the spark plug because of their larger volume.

The injector is fed with gasoline through a line 48 and a pump 50, the pump being in series with a source of gasoline 52. The pump is driven by a hydraulic motor 54, the two being coupled in a standard manner as is shown schematically at 56. Motor 54 is a variable output hydraulic motor and is controlled by operator actuated control linkage at 58. For low load requirements the motor's output is small in comparison with its output at full power and pump 50 has a correspondingly low output. Motor 54 is driven by a pump 60 which in turn is driven by the engine. Motor 54 discharges into reservoir 62. Pump 60 receives its hydraulic fluid from a reservoir 62 and discharges into a line 64 in series with motor 54. An accumulator 66 in series with the outlet of pump 60 provides against fluctuations in hydraulic pressure. Control linkage 58, by determining the output of pump 50, determines the size of the cloud formed in induction pipe 38.

The illustrated engine also provides for water injection to further lower the overall temperature of combustion and to reduce $NO_x$ emissions accordingly. The water injection system includes an injector 68 for injecting a cloud of water into induction pipe 38. Again, the injector can be any of a number of standard designs. A water pump 70 is in series with injector 68 through a line 72 and supplies water at the requisite pressure for injection. Water is taken from a source of water 74. The water pump is driven by a hydraulic motor 76, which in turn is driven by the output from pump 60 through line 64. The coupling between hydraulic motor 76 and pump 70 is shown schematically at 78. The output of hydraulic motor 76 is determined by a linkage control 80 responsive to the dictates of the operator of the engine. The discharge from motor 76 is into reservoir 62.

The timing of the engine can be changed to vary its power and this may be accomplished as follows. An actuator 82 receives hydraulic fluid under pressure from pump 60 through a line 84 and a variable valve 86. Line 84 is connected to line 64. Valve 86 is controlled by the operator of the engine as through control linkage 88. The actuator discharges through a bleed orifice 90 into reservoir 62. The actuator is coupled to a distributor 92 of engine 34 as through linkage 94. The distributor, in a conventional manner, periodically sends a high voltage to each of the spark plugs of the engine. By retarding the spark, that is, by initiating spark later in each cylinder's cycle, the power output of the engine is reduced. This is achieved by rotating the distributor breaker plate with the linkage 94.

Exhaust gas is recirculated from manifold 36 into the induction pipes of the engine through a line 96 between the exhaust manifold and the induction pipes. An infinitely variable valve 98 in line 96 determines flow through the line. The valve is controlled by operator-actuated control linkage 100. An exhaust gas injector 102 is fed by line 96 and is positioned to inject exhaust gas into induction pipe 38.

The above description of fluid control is only one of any number of other systems which will effect the same results.

The positions for water and exhaust gas injection into the induction pipe are determined on an engine-to-engine basis.

Figure 6:
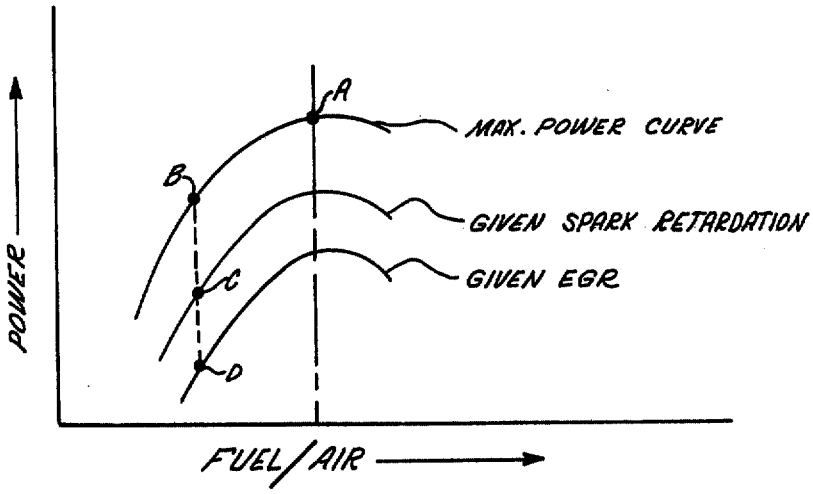
FIG. 6 is a graph of power, qualitatively, versus fuel-air ratio to illustrate a method for varying the power of an internal combustion engine of the present invention.

The engine of FIG. 5 has a variable power output determined by the operator of the engine. How this is accomplished is illustrated in FIG. 6.

Power without exhaust gas recirculation (EGR) and at maximum power spark setting as a function of fuel-to-air ratio is illustrated by the upper curve. The maximum power setting is shown at "A". At maximum power, no exhaust gas is recirculated and the spark is at its optimum setting. Fuel is injected into each of the induction pipes in relatively large amounts to form a relatively large cloud. Upon the opening of the inlet valve, this large cloud will be inducted into the engine and arrive at the spark plug when spark is initiated. For lower power, the fuel-to-air ratio is progressively leaned in fuel by reducing the flow of fuel. In FIG. 5 this may be accomplished by the operator through control linkage 58 which determines the output of injector pump 50.

There is a point where the fuel-to-air ratio can become too lean for satisfactory operation. Just before this point is reached, however, the power of the engine may still be relatively high, say, 50 percent of maximum power. It may be necessary to further reduce the power output of the engine. This may be accomplished as follows. At point "B" in FIG. 6, on the upper curve, spark can be retarded by actuator 82 through operator-controlled control valve 86. As spark is progressively retarded, power progressively diminishes. While spark retardation will be effective to reduce power down to no load, it may be desirable to reduce power by introducing an inert substance into the combustion chamber. Assume that such is the case, power can be reduced from, say, point "C", FIG. 6, by exhaust gas recirculation with the cloud induction and placement technique described.

Exhaust gas is recirculated into induction pipe 38 through infinitely adjustable valve 98, which again is controlled by the operator.

It should be appreciated that this method of changing the power of the engine can be varied in a number of ways. For example, exhaust gas can be continuously injected into the engine, even at the maximum power setting, but progressively increased as lower and lower power requirements dictate. This increase in exhaust gas recirculation can be accompanied by spark retardation and reduction in fuel-to-air ratios.

For best overall fuel economy and emissions it is desirable to operate the engine as lean as consistent with good combustion. Accordingly, adjustment of fuel-to-air ratio progressively leaner from the maximum power setting as power requirements decrease is preferred. It has been observed in a CFR engine operating on natural gas that satisfactory operation at equivalence ratios of up to about 2.0 are possible. At this point misfiring begins to occur.

Engine 34 does not throttle combustion air. Accordingly, the pumping losses of an engine with throttled air are not present and the efficiency of the engine is increased. The lack of combustion air throttling also facilitates a minimum amount of eddying in the induction track, which could otherwise adversely affect the integrity of the cloud of fuel during its transport into the combustion chamber by the air.

In some applications it may be desirable to vary the engine's power output by throttling intake air. In such an application, conventional turbulence screens or honeycombs may be necessary to eliminate eddying or swirls which could othewise break up the fuel cloud.

The geometry of the inlet pipe is not critical so long as the fuel cloud reaches the spark plug at the required time and the cloud has a space in which to form and to be subsequently inducted into the engine. Thus, in place of the induction pipes of FIG. 5, shorter but larger diameter pipes can be used. One method of reducing possible entrance effects on the cloud is to bell the mouth of the induction pipes, as illustrated in FIGS. 2 and 5.

The effects of varying engine speed on cloud transport at the Reynolds numbers of the flows occurring in conventional engines are such that viscous effects will alter the flow pattern very little. Acoustic effects can be made small by making the inlet channels relatively short so their resonant frequencies are large compared to the cyclic frequencies of the engine.

Any desired fuel can be used. A gaseous fuel such as natural gas does not have the problem of maintaining suspension in the cloud. However, gasoline with sufficiently fine particle size to maintain suspension has been found to be quite satisfactory.

The present invention has been described with reference to a certain preferred embodiment. The spirit and scope of the appended claims should not, however, necessarily be limited to the foregoing description.

What is claimed is:

1. In a reciprocating internal combustion engine having for each cylinder an inlet valve, single induction channel means from atmosphere to the inlet valve for fuel and air delivery to the cylinder, a spark plug, and a unitary combustion chamber, an improvement which comprises:

a. means for injecting fuel into the induction channel means at a preselected location to form a coherent combustible cloud in a formation zone therein during the periods of time that the inlet valve is closed, the amount of fuel injected by the injection means effecting an air-to-fuel ratio in the combustion chamber determined on the basis of a homogeneous charge that just prior to the occurrence of spark is too lean to burn;

b. the induction channel means providing a space for a cloud free zone for air between the zone of cloud formation and the spark plug such that upon opening of the inlet valve the cloud will be inducted into the combustion chamber serially with air ahead of it for presence of the cloud at the spark plug when spark occurs and presence of the previously inducted air in a fuel-lean zone in the combustion chamber outside the cloud when spark occurs; and c. the induction channel means and the combustion chamber having a configuration to avoid substantial dissipation of the cloud during the time of the cloud's formation and induction into the combustion chamber to the spark plug until spark occurs so that the combustion chamber just prior to the occurrence of spark has a heterogeneous makeup of fuel and air with the cloud being fuel-rich relative to stoichiometric and the gases in the fuel-lean zone being fuel lean.

2. The improvement claimed in claim 5 wherein the injection means includes means for varying the amount of injected fuel in the cloud, whereby the fuel-to-air ratio is varied and the power of the engine is varied.

3. In a four-cycle internal combustion engine having at least one cylinder, a piston disposed for reciprocation in the cylinder, a unitary combustion chamber defined by the top of the piston and the cylinder when the piston is at approximately its uppermost position therein, a spark plug for initiating combustion in the combustion chamber, an inlet valve for admitting fuel and air into the combustion chamber, and an exhaust valve for exhausting products of combustion from the combustion chamber, an improvement for each cylinder which comprises:

a. induction channel means serially communicating atmosphere with the combustion chamber through the inlet valve for supplying the cylinder with fuel and air;

b. means for injecting fuel into the induction channel means in a zone upstream from the inlet valve during the time between inlet valve openings to develop a fuel-rich combustible cloud in the induction channel means the injection means injecting an amount of fuel which effects an air-to-fuel ratio in the combustion chamber determined on the basis of a homogeneous charge and just prior to the occurrence of spark which is too lean to burn;

c. a space in the induction channel means between the zone where the fuel-rich cloud is formed and the spark plus for assuming presence of the fuel-rich cloud at the spark plug free zone without combustible gases and forming a cloud for assuming presence of the fuel rich cloud at the spark plug at spark;

d. the induction channel means and the cylinder having a configuration to avoid substantial dissipation of the cloud during the formation and subsequent induction of the cloud into the combustion chamber and during the time that the cloud is in the combustion chamber at least until spark occurs so that just prior to the occurrence of spark a heterogeneous change is in the combination chamber defined, relative to stoichiometric, by a fuel-rich cloud and a fuel lean zone of gases outside the cloud, the injection means effecting the injection of an amount of fuel which gives an overall fuel-to-air ratio on the combustion chamber that would be too lean to burn; and e. means for varying the power of the engine without throttline intake air.

4. The improvement claimed in claim 3 wherein the power varying means includes:

means for

5. The improvement claimed in claim 4 wherein the power varying means includes means for recirculating exhaust gases into the combustion chamber through the induction channel means, the recirculating means including an injector for injecting exhaust gas into the induction channel means during the time that the inlet valve is closed and forming a cloud of exhaust gases at a location for induction into the combustion chamber into a preselected position therein at spark.

6. The improvement claimed in claim 5 wherein the power varying means includes means for varying the point in time at which spark occurs during a cycle.

7. The improvement claimed in claim 3 wherein the means for varying the power includes:

means for varying the amount of fuel injected into the induction channel means between a predetermined minimum and a predetermined maximum, the predetermined minimum being at a power output of the engine above no load operation; and means for retarding the spark of the engine for power outputs of the engine below that produced at the predetermined minimum.

8. In a four-cycle, spark ignition, reciprocating internal combustion engine having at least one cylinder, a piston disposed for reciprocation in the cylinder, an inlet and an exhaust valve for the cylinder, a unitary combustion chamber in the cylinder, and a spark plug for igniting a charge of fuel and air in the combustion chamber, an improvement in the induction system for each cylinder which comprises:

a. induction pipe means serially communicating atmosphere with the combustion chamber through the inlet valve;

b. means for injecting fuel into the induction pipe in a fuel injection zone during the time that the inlet valve is closed to form a combustible cloud in the zone the induction pipe means providing a space for a cloud free zonefor air between the zone of cloud formation and the spark plug;

c. the space between the fuel injection zone and the spark plug being such that the cloud will be inducted into the cylinder with air serially ahead of it during the time that the inlet valve is open and be at the spark plug when spark occurs;

d. the induction pipe means and the cylinder preventing substantial dissipation of the cloud during the cloud's formation, induction into the cylinder and arrival at the spark plug when spark occurs;

e. means for varying the fuel-to-air ratio between a predetermined richness and a predetermined leanness by varying the quantity of fuel injected into the induction pipe means, the predetermined lean fuel-to-air ratio corresponding to a power output above no load operation; and f. means for retarding the spark for power outputs between no load and the power output corresponding to the predetermined lean fuel-to-air ratio.

9. A method of operating a reciprocating, spark ignition internal combustion engine comprising the steps of:

a. forming a combustible cloud of fuel in the induction channel of each cylinder of the engine upstream from the inlet valve to the cylinder and upstream from air in the channel during the time between openings of the inlet valve, the cloud being fuel-rich relative to stoichiometric;

b. inducting air and the cloud of fuel into a unitary combustion chamber in the cylinder such that the cloud is at a spark plug in the combustion chamber and the air is in a zone outside the cloud when spark occurs;

c. igniting the cloud with the spark;

d. initiating burning of fuel in the cloud; and e. substantially completing burning of the fuel in the zone containing the air.

10. The method claimed in claim 9 including the steps of:

a. forming a cloud of relatively inert substance in the induction channel of each cylinder separate from the cloud of fuel and upstream from the inlet valve during the periods of time between openings of the inlet valve; and b. inducting the cloud of inert substance into the combustion chamber during the induction step;

whereby the location of the two clouds in the cylinder is determined by their relative positions initially along the induction channel.

11. The method claimed in claim 9 including the step of varying the power of the engine by changing the amount of fuel in the cloud and thereby the fuel-to-air ratio.

12. The method claimed in claim 11 wherein the inducted air is not throttled.

13. The method claimed in claim 11 wherein the power varying step includes changing the time at which spark occurs.

14. The method claimed in claim 13 including the steps of:

a. forming a cloud of relatively inert substance in the induction channel of each cylinder separate from the cloud of fuel upstream from the inlet valve during the time between inlet valve openings; and b. inducting the cloud of inert substance into the cylinder during the induction step.

15. The method claimed in claim 14 wherein the inducted air is not throttled.

* * * * *